United States Patent [19]

Ukita

[11] 3,960,517

[45] June 1, 1976

[54] RESINOID WHEEL CONTAINING A MIXTURE OF TRIMANGANESE TETRAOXIDE AND FERROXIDE AND FERRIC OXIDE FILLERS

[75] Inventor: Junichi Ukita, Sennan, Japan

[73] Assignee: The New Registon Company, Limited, Japan

[22] Filed: Jan. 14, 1975

[21] Appl. No.: 540,959

[30] Foreign Application Priority Data

Oct. 23, 1974 Japan ..... 49-122067

[52] U.S. Cl. ..... 51/298 R; 51/309 R

[51] Int. Cl.[2] ..... C09K 3/14

[58] Field of Search ..... 51/295, 298, 299, 309

[56] References Cited

UNITED STATES PATENTS

| | | | |
|---|---|---|---|
| 2,860,960 | 11/1958 | Gregor | 51/298 |
| 2,940,842 | 6/1960 | Phillips | 51/298 |
| 3,032,404 | 5/1962 | Douglass et al. | 51/298 |

*Primary Examiner*—Donald J. Arnold

*Attorney, Agent, or Firm*—Armstrong, Nikaido & Wegner

[57] ABSTRACT

In a resinoid wheel containing abrasive grains, a binder resin and a filler, an improvement which is characterized in that based on weight ⅓ to ⅔ of the amount of the filler is a mixture of 20 to 55 wt.% of trimanganese tetroxide and 80 to 45 wt.% of ferric oxide.

4 Claims, 2 Drawing Figures

Figure 1:
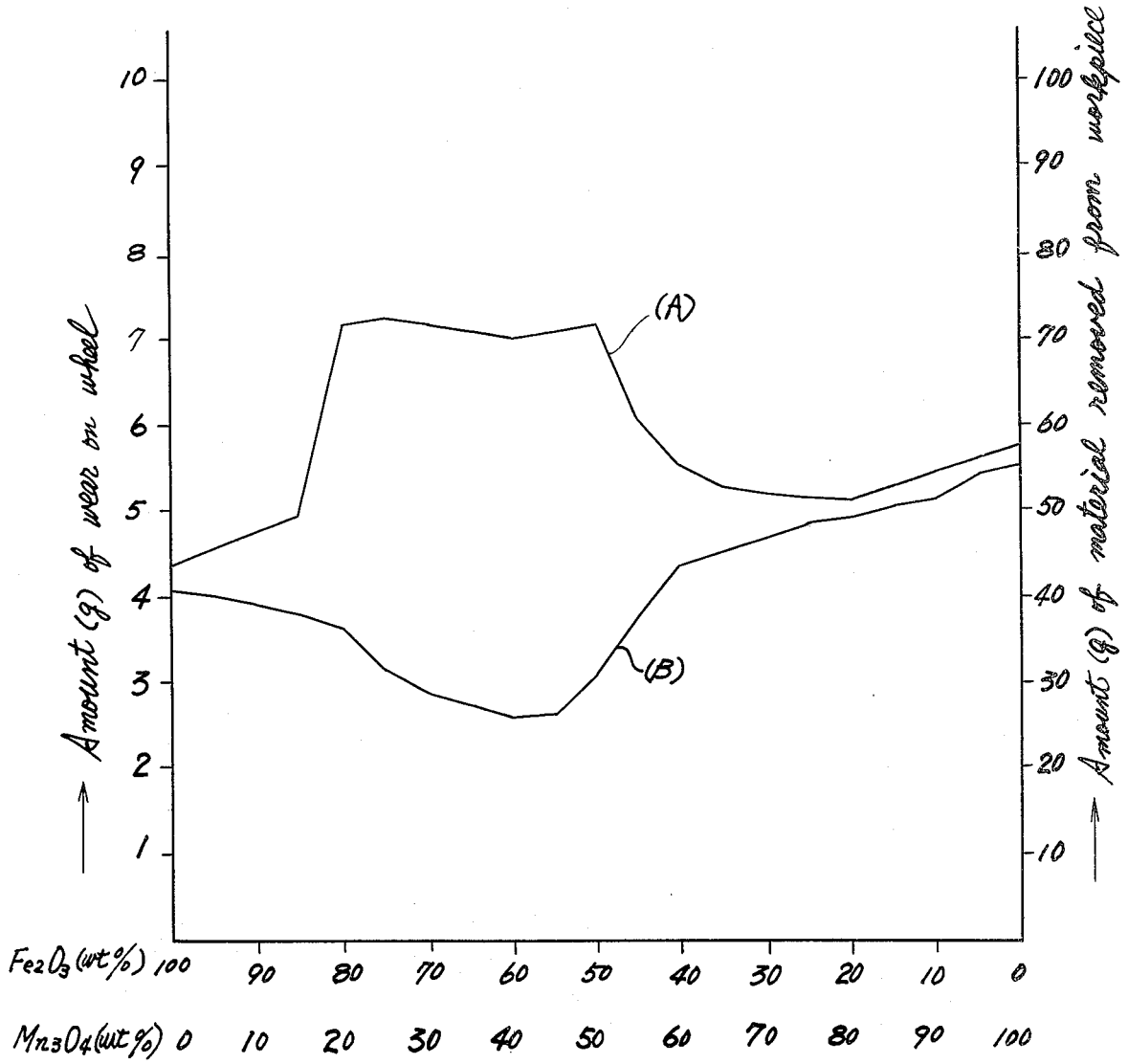

RESINOID WHEEL CONTAINING A MIXTURE OF TRIMANGANESE TETRAOXIDE AND FERROXIDE AND FERRIC OXIDE FILLERS

The present invention relates to a novel resinoid wheel.

Resinoid wheels are made of abrasive grains bonded with a binder such as phenolic resin or like thermosetting resin. When a grinding wheel is used for grinding, the friction between a workpiece and the wheel produces a large amount of heat. If a resinoid wheel is used for grinding, the thermosetting resin serving as a binder is decomposed by the generated heat and is impaired in its bonding properties, this consequently reducing the grinding ability of the resinoid wheel.

To eliminate the above-mentioned drawback, fillers have heretofore been used which act to promote dissipation of the heat resulting from the friction between the resinoid wheel and workpiece, thereby preventing thermal decomposition of the binder resin to the greatest possible extent and improving the performance of the wheel. Examples of such fillers are cryolite, i.e. sodium-aluminum fluoride, iron sulfide, antimony sulfide, etc. which are used singly or in admixture with one another.

Inherently various factors influence the performance of grinding wheel in complex manner. A filler having excellent properties to dissipate heat, for example, a high thermal conductivity, does not always impart an improved grinding ability to the resinoid wheel in which it is incorporated. For instance when a metal powder which has a higher thermal conductivity than the foregoing fillers is used as a filler, the resinoid wheel obtained exhibits a greatly reduced grinding ability. Accordingly, when selecting a filler suitable for a particular resinoid wheel, it is necessary to actually make a resinoid wheel using the filler to determine the performance of the wheel obtained.

Although the above-mentioned substances conventionally used as fillers are effective in improving the grinding ability of the resinoid wheel to some extent, they are still unable to impart a satisfactory ability to the wheel.

An object of this invention is to provide a resinoid wheel having more excellent grinding ability than conventional resinoid wheels containing a filler.

This invention provides a resinoid wheel composed of abrasive grains, a binder resin and a filler and characterized in that based on weight ⅓ to ⅔ of the amount of the filler is a mixture of 20 to 55 wt.% of trimanganese tetroxide and 80 to 45 wt.% of ferric oxide, the remaining ⅓ to ⅔ thereof being a conventional filler material.

We have conducted researches on resinoid wheels composed of abrasive grains, a binder resin and a filler and found that when a resinoid wheel contains a mixture of 20 to 55 wt.% of trimanganese tetroxide and 80 to 45 wt.% of ferric oxide in an amount corresponding to ⅓ to ⅔ of the weight of the filler used therein, the resinoid wheel has a greatly improved grinding ability owing to the synergic effect of trimanganese tetroxide and ferric oxide. Although a full clarification has yet to be made as to why the resinoid wheel exhibits remarkable performance only when the mixture of the above-specified proportions of trimanganese tetroxide and ferric oxide is used therein as part of the filler, the outstanding result is presumably attributable to the following reason. The mixture of trimanganese tetroxide and ferric oxide in the specified ratio is highly compatible with the thermosetting resin used as a binder, permitting the binder resin to effectively cover the abrasive grains, and moreover serves to efficiently dissipate the heat to be generated during grinding operation.

Trimanganese tetroxide has fairly lower thermal conductivity than cryolite which is most widely used as a conventional filler but, when used conjointly with ferric oxide in the specified amount, it gives much higher grinding ability than when cryolite is used singly.

The novel resinoid wheel of this invention contains a mixture of 20 to 55 wt.% of trimanganese tetroxide and 80 to 45 wt.% of ferric oxide in an amount corresponding to ⅓ to ⅔ of the weight of the filler used in the conventional resinoid wheel. If the amount of trimanganese tetroxide in the mixture is less than 20 wt.% or in excess of 55 wt.%, the resulting grinding wheel will not exhibit particularly improved performance as compared with those containing a conventional filler. The amount of trimanganese tetroxide is preferably 30 to 50 wt.%.

Furthermore if the mixture is used in such amount that it is less than ⅓ or more than ⅔ of the filler in weight, even with the trimanganese tetroxide content of the mixture in the range of 20 to 55 wt.%, it is still impossible to achieve a noticeable improvement in the performance of the resinoid wheel. It is especiallly preferable to use the mixture in an amount of 2/5 to 3/5 of the filler in weight.

The mixture of trimanganese tetroxide and ferric oxide to be used in the present invention may be prepared simply by mixing trimanganese tetroxide and ferric oxide in the specified ratio, or by firing a mixture of metal iron and manganese carbonate at about 800° to 1,000°C and crushing the fired product to the same particle sizes as conventional fillers. Preferable particle size of the mixture of trimanganese tetroxide and ferric oxide is in the range of 250 to 325 mesh.

Effectively usable as the conventional filler in combination with the mixture of the specified proportions of trimanganese tetroxide and ferric oxide is any of various known fillers heretofore used as the fillers for resinoid wheels of the type described. Examples are cryolite, iron sulfide, antimony sulfide, etc.

According to this invention, the filler is used in an amount of 1 to 20 parts by weight, preferably about 5 to about 15 parts by weight, per 100 parts by weight of abrasive grains.

Abrasive grains generally used for resinoid wheels of the foregoing type are usable as such according to this invention. Examples are abrasive grains of fused alumina and those of silicon carbide, which may be used singly or in admixture. The binders to be used for bonding the abrasive grains together are thermosetting synthetic resins such as phenolic resin, epoxy resin, melamine resin, etc., among which phenolic resin is preferable. Such thermosetting resin is used in an amount of 15 to 30 parts by weight, preferably about 20 to 25 parts by weight, per 100 parts by weight of abrasive grains.

The resinoid wheel of this invention can be manufactured in the same manner as conventional resinoid wheels, e.g. typically by the following method.

Abrasive grains, filler and binder resin are mixed together in predetermined proportions. These three ingredients are mixed together at the same time, or abrasive grains and filler are first mixed together and binder resin is then added to the resulting mixture. Alternatively, abrasive grains are mixed with a mixture of binder resin and filler previously prepared. Usable as the binder resin is a single binder resin in liquid state, but it is preferable to conjointly use liquid binder resin and powdery binder resin. By conjoint use of liquid binder resin and powdery binder resin it becomes more easy to mix abrasive grains, binder resin and filler. In this case, liquid binder resin, abrasive grains and filler are mixed together first and powdery binder resin is then added to the resulting mixture.

The mixture of abrasive grains, binder resin and filler is then molded in a conventional manner by compression molding. Glass cloth or like reinforcing material may be incorporated into the molded mixture, whereby the mechanical strength of the resulting wheel can be increased.

The molded product obtained is dried when so desired and then sent to the next step in which the binder resin is hardened. The molded product need not necessarily be subjected to the drying step but, when dried, the raw molded product in which the binder resin has not been hardened will have improved mechanical strength, which serves to reduce the possible damage to the molded product during transport or hardening step. For hardening, the molded product is heated at a temperature sufficient to harden the binder resin used. For example, when phenolic resin is used as the binder resin, the molded product is heated at about 170° to 210°C.

The present invention will be described below with reference to examples, in which the parts and percentages are all by weight.

EXAMPLE 1

Ten kilograms of brown fused alumina abrasive grain (fused alumina abrasive grain A 24 #, product of Nihon Kenmazai Kogyo Co., Ltd., Japan), 250 g of cryolite having a particle size of 250 to 325 mesh (product of Central Glass Co., Ltd., Japan), 250 g of a mixture of trimanganese tetroxide and ferric oxide in a weight ratio of 35:65, and 750 g of liquid phenolic resin were mixed together, and 750 g of powdered phenolic resin was then added to the resulting mixture with stirring. The mixture was then packed into a disc-like die measuring 180 mm in diameter and 6 mm in thickness, with two sheets of glass cloth (glass cloth No. 350, product of Unitika Co., Ltd., Japan) placed in layers in the mass of mixture as spaced apart by 2 mm from its upper and lower surfaces respectively. The mass was then compressed at pressure of 100 kg/cm² at room temperature into a molded product, which was dried at 110°C for 10 hours and then heated at 170° to 200°C for 5 hours to obtain a resinoid wheel.

The grinding wheel obtained was used for grinding a workpiece of mild steel (JIS G 3141, class 1). The wheel was driven at 7,000 r.p.m. to conduct grinding operation at pressure of 7.5 kg/cm² for 5 minutes. The amount of the material removed from the workpiece and the amount of wear on the wheel were measured to calculate grinding ratio and operation efficiency by the following equations:

$$\text{Grinding ratio} = \frac{\text{Amount of material removed}}{\text{Amount of wear on wheel}}$$

$$\text{Operation efficiency} = \frac{(\text{Amount of material removed})^2}{\text{Amount of wear on wheel}}$$

The results are given in Table 1 below.

COMPARISON EXAMPLE 1

A resinoid wheel was produced in the same manner as in Example 1 except that 500 g of cryolite was used in place of 250 g of the same, without using any amount of the mixture of trimanganese tetroxide and ferric oxide. Using the resinoid wheel, performance test was conducted in the same manner as in Example 1. The results are given in Table 1 below.

Table 1

| | Example 1 | Comp. Ex. 1 |
|---|---|---|
| Amount (g) of wear on wheel | 3 | 4 |
| Amount (g) of material removed from workpiece | 60 | 44 |
| Grinding ratio | 20 | 11 |
| Operation efficiency | 1,200 | 484 |

Table 1 above reveals that the grinding wheel of this invention exhibits remarkably improved performance as compared with the wheel containing the conventional filler of cryolite.

EXAMPLE 2

Figure 2:
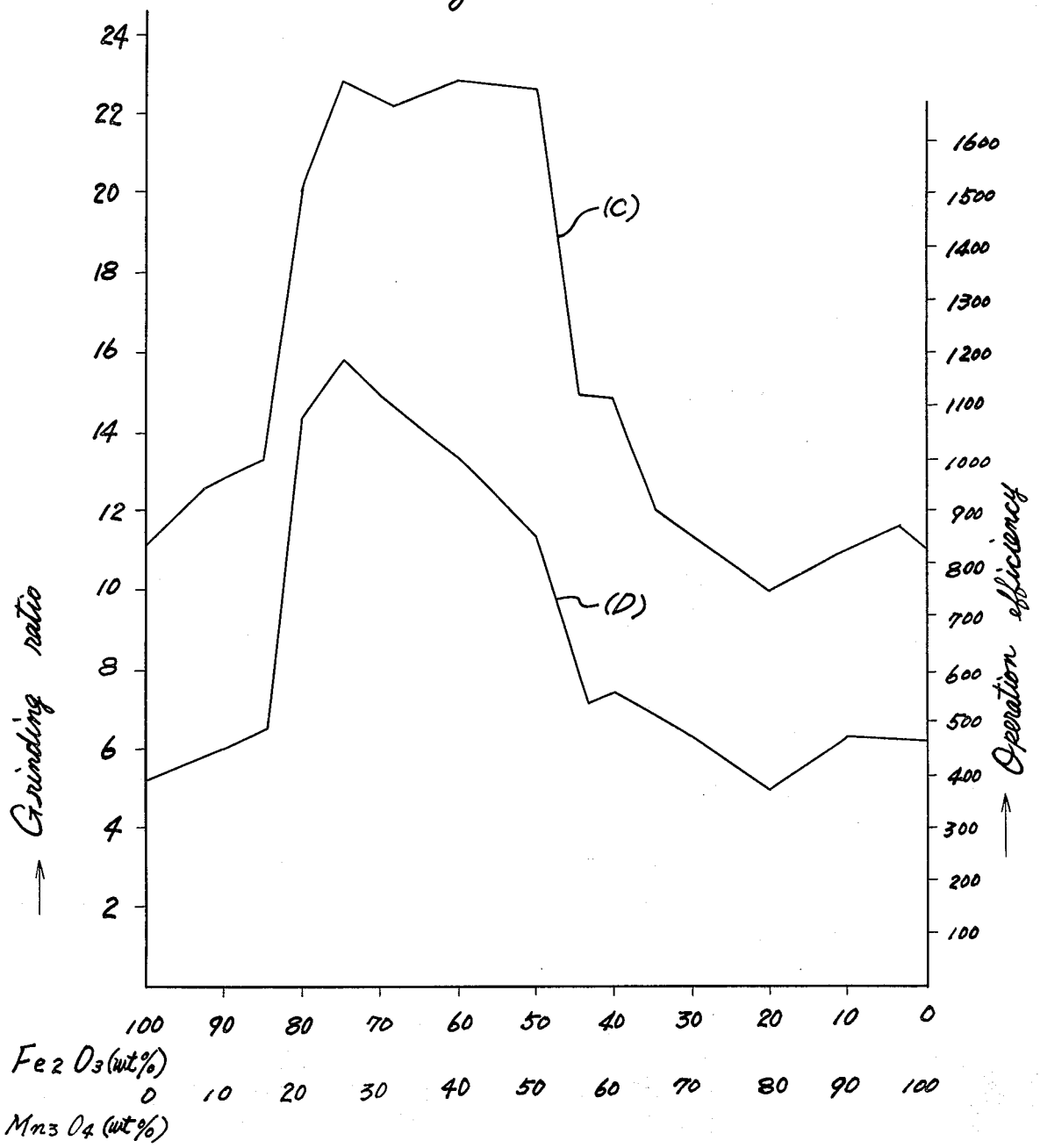

Resinoid wheels were produced in the same manner as in Example 1 except that 250 g of mixtures of trimanganese tetroxide and ferric oxide in the proportions specified in FIG. 1 and FIG. 2 were used in place of the mixture of trimanganese tetroxide and ferric oxide in the weight ratio of 35:65. Each of wheels obtained was tested in the same manner as in Example 1 to determine the amount of material removed from the workpiece, the amount of wear on the wheel, grinding ratio and operation efficiency. The amount of removal and the amount of wear are shown in FIG. 1, while grinding ratio and operation efficiency are shown in FIG. 2. In FIG. 1 the amount of removal and the amount of wear are plotted as ordinate vs. the ratio of trimanganese tetroxide to ferric oxide as abscissa. Indicated at (A) in FIG. 1 is the amount of removal and at (B), the amount of wear. Further in FIG. 2, grinding ratio and operation efficiency are plotted as ordinate, whilst the ratio of trimanganese tetroxide to ferric oxide is plotted as abscissa. Indicated at (C) in FIG. 2 is grinding ratio and at (D), operation efficiency.

FIGS. 1 and 2 reveal that when the ratio by weight of trimanganese tetroxide to ferric oxide is in the range of 20:80 to 55:45, remarkable results are available which clearly indicate the synergic effect of these two ingredients.

EXAMPLE 3

A resinoid wheel was produced in the same manner as in Example 1 except that cryolite and the mixture of trimanganese tetroxide and ferric oxide in the weight ratio of 25:75 were used in the proportions specified in Table 2 below in place of 250 g of cryolite and 250 g of the mixture of trimanganese tetroxide and ferric oxide in the weight ratio of 35:65.

The amount of the material removed from the workpiece and the amount of wear on the wheel were measured, and grinding ratio and operation efficiency were respectively calculated by the same method and equations as in Example 1.

The results are given in Table 2 below.

Table 2

| The mixture of $Fe_2O_3$ and $Mn_3O_4$ (%) | Cryolite (%) | Amount(g) of wear on wheel | Amount(g) of material removed from workpiece | Grinding ratio | Operation efficiency |
|---|---|---|---|---|---|
| 0 | 100 | 4.0 | 44 | 11.0 | 484 |
| 10 | 90 | 3.9 | 45 | 11.5 | 519 |
| 20 | 80 | 3.6 | 47 | 13.1 | 614 |
| 30 | 70 | 3.1 | 53 | 17.1 | 906 |
| 40 | 60 | 3.0 | 57 | 19.0 | 1083 |
| 50 | 50 | 3.0 | 60 | 20.0 | 1200 |
| 60 | 40 | 3.1 | 60 | 19.4 | 1161 |
| 70 | 30 | 3.2 | 58 | 18.1 | 1052 |
| 80 | 20 | 3.8 | 51 | 13.4 | 684 |
| 90 | 10 | 4.0 | 48 | 12.0 | 576 |
| 100 | 0 | 4.5 | 42 | 9.0 | 392 |

EXAMPLES 4 to 7

Resinoid wheels were produced in the same manner as in Example 1 except that in place of cryolite, iron sulfide, and antimony sulfide were used respectively. The resinoid wheels obtained exhibited nearly the same performance as that of Example 1.

What we claim is:

1. In a resinoid wheel containing abrasive grains, a thermoset resin binder and a filler, the filler being present in an amount of 1 to 20 parts by weight of abrasive grains, the improvement which is characterized in that of the total amount filler in the wheel, 30% to 70% is a mixture of 20 to 55 weight % of trimanganese tetraoxide and 80 to 45 weight % of ferric oxide.

2. The resinoid wheel as set forth in claim 1 wherein said mixture comprises 30 to 50 wt.% of trimanganese tetroxide and 70 to 50 wt.% of ferric oxide.

3. The resinoid wheel as set forth in claim 1 wherein based on weight 2/5 to 3/5 of the amount of the filler is a mixture of 20 to 55 wt.% of trimanganese tetroxide and 80 to 45 wt.% of ferric oxide.

4. The resinoid wheel as set forth in claim 1 wherein based on weight ⅓ to ⅔ of the amount of the filler is a mixture of 20 to 55 wt.% of trimanganese tetroxide and 80 to 45 wt.% of ferric oxide and the balance of the filler is at least one species selected from the group consisting of cryolite, iron sulfide and antimony sulfide.

* * * * *